US009205693B2

(12) United States Patent
Higashiguchi et al.

(10) Patent No.: US 9,205,693 B2
(45) Date of Patent: Dec. 8, 2015

(54) CLOTH MATERIAL FOR MARKING AND METHOD OF FORMING MARK

(75) Inventors: Shigeji Higashiguchi, Tokyo (JP); Shinichi Nagai, Tokyo (JP)

(73) Assignee: HOULAISHA CO., LTD., Tokyo (JP)

( * ) Notice: Subject to any disclaimer, the term of this patent is extended or adjusted under 35 U.S.C. 154(b) by 100 days.

(21) Appl. No.: 14/116,774

(22) PCT Filed: May 11, 2012

(86) PCT No.: PCT/JP2012/062726

§ 371 (c)(1), (2), (4) Date: Nov. 11, 2013

(87) PCT Pub. No.: WO2012/157731

PCT Pub. Date: Nov. 22, 2012

(65) Prior Publication Data

US 2014/0087097 A1 Mar. 27, 2014

(30) Foreign Application Priority Data

May 13, 2011 (JP) ..... 2011-108239

(51) Int. Cl.

| | |
|---|---|
| ***B41M 3/12*** | (2006.01) |
| ***B41M 5/382*** | (2006.01) |
| ***B41M 5/50*** | (2006.01) |
| ***B41M 5/52*** | (2006.01) |
| ***D06P 5/00*** | (2006.01) |
| ***D06P 5/28*** | (2006.01) |
| ***D06Q 1/12*** | (2006.01) |

(52) U.S. Cl.

CPC ..... *B41M 5/38214* (2013.01); *B41M 3/12* (2013.01); *B41M 5/506* (2013.01); *B41M 5/5272* (2013.01); *D06P 5/004* (2013.01); *D06P 5/005* (2013.01); *D06Q 1/12* (2013.01); *B41M 2205/02* (2013.01); *B41M 2205/10* (2013.01)

(58) Field of Classification Search

CPC .... B41M 3/12; B41M 5/382; B41M 5/38214; B41M 5/50; B41M 5/52; B41M 5/5272; B41M 5/5258; B41M 2205/02; B41M 2205/10; D06P 5/00; D06P 5/005

USPC ..... 428/32.51; 503/227; 156/25, 240, 235; 8/471

See application file for complete search history.

(56) References Cited

U.S. PATENT DOCUMENTS 5,411,783 A * 5/1995 Mahn, Jr. ..... 428/79

* cited by examiner

*Primary Examiner* — Bruce H Hess

(74) *Attorney, Agent, or Firm* — Solaris Intellectual Property Group, PLLC

(57) ABSTRACT

The invention provides a cloth material for marking including, in this order, a label cloth formed from a fiber, an intermediate layer including a resin having a softening point of 180° C. or higher, a transfer adhesive layer including a thermoplastic resin having a softening point of 170° C. or lower and having a melt flow rate of 100 g/10 min or lower; and a release sheet.

12 Claims, 3 Drawing Sheets

CLOTH MATERIAL FOR MARKING AND METHOD OF FORMING MARK

TECHNICAL FIELD

The present invention relates to a cloth material for marking or label making where the mark or label can be transfer-printed, and a method of forming a mark. The present invention employs a sheet of transfer paper, on which various colors, patterns, designs and/or the like are printed using a sublimation dye, and the color, patterns, designs and/or the like of the transfer paper are transferred to a surface of the cloth material.

BACKGROUND ART

Hereinbelow, a conventional process for producing a label, including a patch (called also a "mark") and the structure of the label itself produced by the process will be described with reference to FIGS. 3 to 6.

First, a label cloth 1 is prepared from a cloth such as textile fabrics, knitted fabrics, non-woven fabrics and the like, to which fabrics a desired color, a desired pattern, a desired design and/or the like are printed by silk-screen printing process or the like.

Next, a rear surface of the label cloth 1 is coated with a pasty hot-melt type thermoplastic synthetic resin to a predetermined thickness, and then dried to form a so-called transfer adhesive layer 2. Alternatively, the transfer-printing adhesive layer 2 may be formed by a process such as laminating a hot-melt thermoplastic synthetic resin film having a predetermined thickness to a rear surface of the label cloth 1. The transfer adhesive layer 2 contains a hot-melt thermoplastic synthetic resin as one of its components. The adhesive layer 2 thus formed is then backed with a release sheet 3 to prepare a cloth material for label making, that is, a cloth material for marking 4 as shown in FIG. 3.

In preparing a label from the cloth material for marking 4, the cloth material for marking 4 is cut into a desired shape to obtain label 5 having desired colors, patterns and/or designs as shown in FIG. 4.

Accordingly, the conventional label has a structure as shown in FIG. 4, in which transfer adhesive layer 2 is formed on label cloth 1, lined with release sheet 3.

Next, a procedure by which label 5 is bonded to clothes such as a uniform or like items will be described.

First, the release sheet 3, which has been placed on the transfer adhesive layer 2 on the rear surface of the label 5, is removed.

The label 5 is overlaid on cloth surface such as a uniform (not shown) with the transfer adhesive layer 2 being touched with the cloth surface. Then, the label 5 and the cloth thus coupled one another are subjected to a hot pressing process in which they are compressed together under a pressure of approximately 200 g/cm$^2$ for about 30 seconds at a temperature of approximately 150° C. using a hot press or the like, so that the transfer adhesive layer 2 of the label 5 is melted between the cloth of the uniform or the like and the cloth of the label 5, whereby the cloth of the label 5, that is, the cloth material for marking 4 and the corresponding cloth of the uniform or the like are bonded to each other through the application of heat without damaging the cloths.

Incidentally, the development of transfer paper has been advanced in that various colors, patterns, designs and the like are printed on a sheet of transfer paper with a so-called sublimation dye. Along with the conventional silk screen process printing techniques, techniques for producing a cloth material for a label or a mark (hereinafter referred to as "a cloth material for marking") have come to be widely used in the art of making a cloth material where transfer paper such as having a structure as shown in FIG. 5 is used.

Hereinbelow, the techniques for producing a cloth material for marking having a structure shown in FIG. 5 using the transfer paper currently employed in the art of label making will be described.

As label cloth 6 (a component of the cloth material for marking 11), a cloth having affinity for a sublimation dye so that the dye is sublimated and transferred onto the cloth may be selected. Typical examples of such a cloth include a white cloth (a cloth having a white base) of textile fabrics, knitted fabrics, non-woven fabrics and the like made of, for example, polyester fibers. A composite cloth 8 is prepared to produce a cloth material for marking 11 shown in FIG. 5, where composite cloth 8 is prepared by: applying a temporary adhesive 7' on a non-woven fabric 7; overlaying label cloth 6 on the non-woven fabric 7 on the side where the temporary adhesive 7' is applied; subjecting the cloth to heating/pressing operations by a heating/pressing machine, whereby the composite cloth 8 backed with the non-woven fabric 7 is prepared.

Then, the printed surface of the transfer paper is pressed against a surface of the white label cloth 6 of the composite cloth 8 and heating/pressing operation is performed by the heating/pressing machines and the like. The colors, patterns, designs and the like that have been printed on the transfer paper with the sublimation dye are transfer-printed onto the surface of the white label cloth 6 by sublimating the sublimation dye.

The above-mentioned transfer printing (sublimation transfer) is carried out on the following conditions: heating temperature of approximately 180 to approximately 210° C.; pressure of approximately 1 to approximately 2,000 g/cm$^2$; and a period of the heating/pressing processes of approximately 30 to approximately 90 seconds.

On a surface of the non-woven fabric 7 of the composite cloth 8, a transfer adhesive layer is formed with a hot-melt type thermoplastic synthetic resin according to a conventional method. The transfer adhesive layer has the function of transferring/applying the mark to an object such as a user's uniform and like items. Then, the release sheet 10 is applied to a surface of the transfer adhesive layer 9 to obtain the cloth material for marking 11 having the structure shown in FIG. 5.

Similar to the transfer adhesive layer 2 for a conventional type of a cloth material for marking shown in FIG. 3, the transfer adhesive layer 9 is usually set to have a melting point of approximately 150° C., and is supposed to be subjected to heating and pressing processes for about 30 seconds under approximately 200 g/cm$^2$ of pressure.

In order to obtain a label from the cloth material for marking 11 that has been produced by the above-described means, the cloth material for marking 11 is cut into a desired shape to obtain the label 12 as shown in FIG. 6.

Therefore, it should be noted that it is impossible to produce a cloth material for marking 11 in the following manner: preparing a label cloth 6 selected from white cloths such as textile white fabrics, knitted white fabrics, non-woven white fabrics and like made of polyester fibers; preparing composite cloth 8 by backing the label cloth 6 with a non-woven fabric 7 with a temporary adhesive 7; completing the preparation of the cloth material for marking by forming a transfer adhesive layer 9 on a rear surface of the composite cloth 8; and, after that, transferring colors, patterns, designs and the like printed on the transfer paper with the sublimation dye onto the cloth of label cloth 6 of the composite cloth 8 that is a component of the cloth material for marking so as to produce a cloth material for marking 11 with colors, etc. transferred thereon.

The following reasons can be raised for why it is impossible to produce the cloth material for marking 11 in the above procedure. First, the transferring temperature at which colors, patterns and designs are transferred onto label cloth 6 of a cloth material for marking by sublimating the sublimation dye printed on the transfer paper is different from the melting point (temperature) of the transfer adhesive layer 9 formed on the cloth material for marking Second, due to differences in pressure and time period of the transfer-printing process, the transfer adhesive layer 9 is melted first so that the molten resin of the transfer adhesive layer 9 seeps and soaks through the non-woven fabric 7 of composite cloth 8, whereby the molten resin appears and covers the front surface of the label cloth 6. This results in a failure in the transfer-printing process since the molten resin forms a thin film on the surface of the label cloth 6.

Furthermore, other disadvantages may arise in a case in which the label (including a patch) is bonded to the user's uniform and like items under conditions in which: a heating and pressing machine of the conventional type is used in applying the label to the uniform and like items; the label cloth 6 is prepared from white textile fabrics, knitted fabrics, non-woven fabrics and like white fabrics formed from polyester fibers currently widely used in the art of the label; this label cloth 6 is backed with the non-woven fabric 7 to prepare the composite cloth 8, wherein a temporary adhesive 7' has been applied to the non-woven fabric 7; the label cloth 6 of the composite cloth 8 is transfer-printed by using the transfer paper so that the label cloth 6 bears the colors, patterns and the designs thus transfer-printed; the transfer adhesive layer 9 is formed in the non-woven fabric 7 of the composite cloth 8, so that the label 12 shown in FIG. 6 is produced, wherein the cloth material for marking 11 is subjected to templating process to assume the shape of the label 12. The specific disadvantages are set forth below.

Although the non-woven fabric 7 of the composite cloth 8 forming a component of the label is firmly bonded to the user's uniform and like items, the label 12 bonded to the uniform and the like is poor in durability in washing since the non-woven fabric 7 and the label cloth 6 is temporarily bonded to each other through the temporary adhesive 7'. This results in a peeling-off accident of the label 12 during washing the clothes. The label is also poor in abrasion resistance.

When the transfer adhesive layer 9 is formed after removing the non-woven fabric 7 after completion of the transfer printing process of the colors, patterns and designs of the transfer paper transferred onto the label cloth 6 of the composite cloth 8, the label cloth 6 having been transfer-printed to bear the colors, patterns and the designs using the transfer paper described above has the disadvantage that the label cloth 6 is deformed during the removing (peeling-off) operation.

Further, another disadvantage appears when the temporary adhesive 7' is increased in thickness in order to solve the above-mentioned disadvantages and in order to more firmly bond the non-woven fabric 7 to the label 6 so that the composite cloth 8 is produced. A cloth material for marking 11 is prepared by forming a transfer adhesive layer 9 on a non-woven fabric 7 of the composite cloth 8. A label 12 is cut out from the cloth material for marking 11 and the label 12 thus obtained is usually adhered to an uniform and the like by a hot press process in accordance with a conventional method. The temporary adhesive 7' thus increased in thickness is melted so that the molten resin of the temporary adhesive 7' seeps and soaks through the non-woven fabric 7 to appear in the back-side of the non-woven fabric 7, whereby such molten resin forms a film over the surface of the label cloth 6. As a result, it is impossible to produce a good product or label cloth material for marking when the cloth material for marking formed from the composite cloth 8 having a temporary adhesive 7' with increased thickness; and, also impossible to produce a good label when the cloth material for marking formed from the composite cloth 8 described above.

As a label cloth which is improved in the above problems, a cloth material for marking is disclosed which is characterized by a structure obtained by using a white cloth including fibers containing a component having affinity for a sublimation dye as the label cloth constituting the cloth material for marking, forming an intermediate layer on the rear surface of the label cloth which is the above cloth, the intermediate layer including a synthetic resin having affinity for the component of the cloth which is a component of the label cloth which is the above cloth and has a softening temperature set to a higher temperature than a sublimation temperature of the sublimation dye, forming a transfer adhesive layer including a hot-melt thermoplastic synthetic resin on the intermediate layer and applying a release sheet to the surface of the transfer adhesive layer (Japanese Patent Application Laid-Open (JP-A) No. 2006-322129).

DISCLOSURE OF THE INVENTION

Problems to be Solved by the Invention

The invention has been made under these circumstances, and provides a cloth material for marking capable of forming desired colors, patterns and designs in a cloth, which is formed into a label cloth by using a sheet of transfer paper having been printed with a sublimation dye, so that the disadvantages of the conventional type of a cloth material for marking and of a label both currently produced in the art of the label and the cloth material for marking.

In a case in which the intermediate layer including a synthetic resin having a softening point higher than a sublimation temperature of the sublimation dye is formed in the cloth material for marking which is used for sublimation transfer as mentioned above, this can prevent the occurrence of such a phenomenon that the transfer adhesive layer is melted by heat and pressure during transferring when a pattern is formed by sublimation transfer and seeps and soaks into the surface (surface to which a pattern is transferred) of the label cloth. However, in the case of using a method, for example, coating, when the intermediate layer is formed in the label cloth, there is the case where some factors such as cloth texture density, projections/recesses of weave, and an impact during handling cause the generation of pinholes and fine cracks in the intermediate layer. Though these pinholes have a diameter as small as about 10 to 200 μm, there is also the case where the number of these pinholes to be generated becomes about $20/cm^2$ when many pinholes are generated.

Even in the case of forming the intermediate layer as mentioned above, the dissolved transfer adhesive layer may pass through the intermediate layer via the pinholes in the sublimation transfer of a pattern, with the result that there is the case where it seeps and soaks into the surface of the label cloth if such pinholes and fine cracks are generated in the intermediate layer. If a resin and the like seep and soak into the surface of the label cloth, the release sheet is bonded with the surface of the label cloth by the seeping and soaking resin, giving rise to a failure in transfer such as paper breakage when the release sheet of the sublimation transfer sheet is peeled from the cloth material for marking after the sublimation transfer is finished.

It is an object of the present invention to provide a cloth material for marking which prevents the transfer adhesive layer from seeping and soaking into the surface of the label cloth when heated and pressed and a method of forming a mark using the cloth material for marking.

Means for Solving the Problem

A cloth material for marking according to the present invention includes, in this order, a label cloth formed from a fiber, an intermediate layer containing a resin having a softening point of 180° C. or higher, a transfer adhesive layer containing a thermoplastic resin having a softening point of 170° C. or lower and having a melt flow rate of 100 g/10 min or lower, and a release sheet.

The cloth material for marking according to the present invention is provided with the intermediate layer containing a resin having a softening point of 180° C. or higher and the transfer adhesive layer (hot melt layer) containing a thermoplastic resin having a softening point of 170° C. or lower and having a melt flow rate of 100 g/10 min or lower, wherein the intermediate layer intermediates between the label cloth and the transfer adhesive layer. This structure can limit the occurrence of such a phenomenon that when the cloth material for marking is heated and pressed to form a pattern using a sublimation dye, the thermoplastic resin constituting the transfer adhesive layer is melted and seeps and soaks into the surface of the label cloth. Furthermore, a release sheet is disposed (baked) on the transfer adhesive layer on the side opposite to the surface on which the intermediate layer is formed. Therefore, the adhesion of the thermoplastic resin to others can be prevented even if the thermoplastic resin which forms the transfer adhesive layer during sublimation transfer is melted.

Furthermore, the transfer adhesive layer in the present invention is composed of a thermoplastic resin having a melt flow rate of 100 g/10 min or lower. When the melt flow rate of the thermoplastic resin constituting the transfer adhesive layer is 100 g/10 min or lower, the thermoplastic resin penetrates into pinholes of the intermediate layer with difficulty even if the thermoplastic resin of the transfer adhesive layer is melted in the heating and pressure condition adopted when a pattern is formed on the cloth material for marking by using a sublimation dye even in the case where pinholes, fine cracks and the like are generated in the intermediate layer. This can prevent the thermoplastic resin constituting the transfer adhesive layer from seeping and soaking into the surface of the label cloth during sublimation transfer even in the case where pinholes, fine cracks and the like are generated in the intermediate layer.

The present invention also relates to a method of forming a mark including providing a cloth material for marking; and sublimation transferring a pattern formed on a transfer sheet with a sublimation dye onto a surface of the cloth material, wherein the cloth material for marking includes, in this order, at least a label cloth formed from a fiber, an intermediate layer including a resin having a softening point higher than a sublimation dye of the sublimation dye, a transfer adhesive layer including a thermoplastic resin having a softening point lower than the sublimation temperature of the sublimation dye and having a melt flow rate of 100 g/10 min or lower, and a release sheet.

The intermediate layer of the cloth material for marking in the method of forming a mark according to the present invention is constituted by using a resin having a softening point higher than the sublimation temperature of the sublimation dye. This can limit the occurrence of such a phenomenon that the transfer adhesive layer composed of a thermoplastic resin having a softening point lower than the sublimation temperature of the sublimation dye is melted and seeps and soaks into the surface of the label cloth during sublimation transfer when a pattern formed with the sublimation dye is transferred on a surface of the label cloth of the cloth material for marking. As the softening point of the resin included in the intermediate layer is preferably higher than the heating temperature of pattern forming step during the sublimation transfer of the sublimation dye. Furthermore, a release sheet disposed (backed) on the transfer adhesive layer on the side opposite to the surface on which the intermediate layer is formed. Therefore, the adhesion of the thermoplastic resin to others can be prevented even if the thermoplastic resin which forms the transfer adhesive layer is melted during sublimation transfer.

Furthermore, the transfer adhesive layer in the method of forming a mark according to the present invention is composed of a thermoplastic resin having a melt flow rate of 100 g/10 min or lower. When the melt flow rate of the thermoplastic resin constituting the transfer adhesive layer is 100 g/10 min or lower, the thermoplastic resin penetrates into pinholes of the intermediate layer with difficulty even if the thermoplastic resin of the transfer adhesive layer is melted in the heating and pressure condition adopted when a pattern is formed on the cloth material for marking by using a sublimation dye even in the case where pinholes, fine cracks and the like are generated in the intermediate layer. This can prevent the thermoplastic resin constituting the transfer adhesive layer from seeping and soaking into the surface of the label cloth even in the case where pinholes, fine cracks and the like are generated in the intermediate layer.

Effect of the Invention

The present invention can provide a cloth material for marking which prevents the transfer adhesive layer from seeping and soaking into the surface of the label cloth when heated and pressed and a method of forming a mark by using the cloth material for marking.

BRIEF DESCRIPTION OF THE DRAWINGS

Exemplary embodiments of the present invention will be described in detail, based on the following figures, wherein.

BEST MODE FOR CARRYING OUT THE INVENTION

Figure 1:
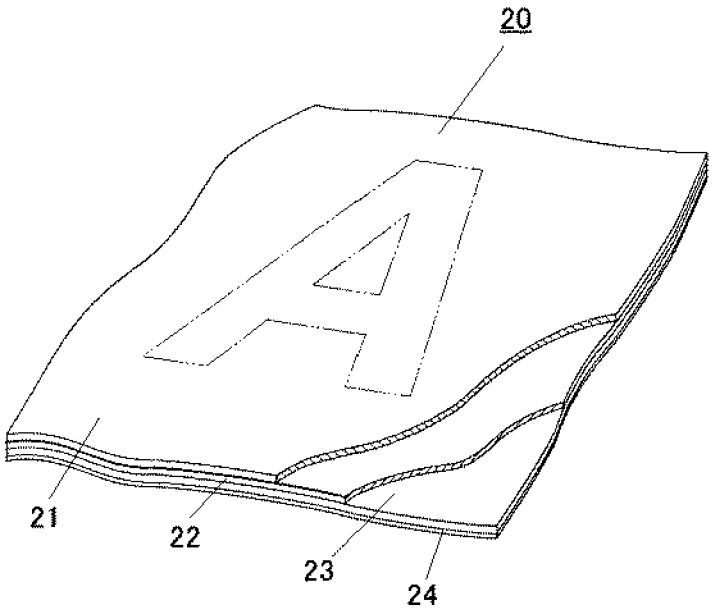
FIG. 1 is a partially broken perspective view of a cloth material for marking of the present invention.

The present invention provides: providing a label cloth made of a white cloth including fibers containing a component having affinity, preferably for a sublimation dye; forming an intermediate layer with a synthetic resin having a softening point higher than a sublimation transfer temperature with the sublimation dye; forming a transfer adhesive layer on the intermediate layer including a hot-melt type thermoplastic synthetic resin; and backing with a release sheet to prepare a cloth material for marking Therefore, it would be possible for a label producer to produce a label cloth and produce a mark (or label) having desired colors, patterns, and/or designs by transfer-printing a sublimation dye from transfer paper with a conventional type of heating and pressing machine, if the label producer obtained the cloth material for marking of the present invention.

—Cloth material for marking—

The cloth material for marking according to the present invention includes a label cloth formed from a fiber, an intermediate layer containing a resin having a softening point of 180° C. or higher, a transfer adhesive layer containing a thermoplastic resin having a softening point of 170° C. or lower and having a melt flow rate of 100 g/10 min or lower, and a release sheet in this order.

The cloth material for marking according to the present invention is preferably used, particularly, for mark-forming applications involving a process of transferring a pattern formed with a sublimation dye. Specifically, the cloth material for marking according to the present invention enables the sublimation transfer of a pattern formed on a transfer sheet with a sublimation dye onto the surface of the label cloth by heating and pressure while it is preliminarily provided with a transfer adhesive layer used for applying it to clothes such as uniforms and other various kinds of objects. The cloth material for marking according to the present invention is free from the seeping and soaking of the transfer adhesive layer into the label cloth during sublimation transfer, and also, such a risk that designs formed by a sublimation dye are damaged or distorted by the subsequent processing treatment can be outstandingly reduced because it is unnecessary to form any adhesive layer separately after the designs and the like are formed. Furthermore, after a mark design and the like are formed, the label cloth is cut into a desired form as needed, then, the release sheet is peeled off, and the cut cloth is then overlapped on the surface of a cloth such as a uniform, followed by pressing using a heating and pressing machine, whereby the mark can be applied to an object.

The condition under which the sublimation dye is transferred is usually as follows: temperature: 180 to 210° C., pressure: 1 to 2,000 g/cm$^2$, time: about 30 to 90 sec, though it is usually set based on the sublimation temperature of the sublimation dye. The intermediate layer in the cloth material for marking according to the present invention is structured using a resin having a softening pint of 180° C. or higher so that it is not melted even under the transfer condition used when such a sublimation dye is transferred to the label cloth. For this reason, the intermediate layer functions as a barrier layer which prevents the thermoplastic resin of the molten transfer adhesive layer from seeping and soaking into the label cloth during sublimation transfer.

As the thermoplastic resin (hot melt resin) constituting the transfer adhesive layer in the present invention, those having a softening point of 170° C. or lower which is lower than the sublimation temperature of the sublimation dye constituting designs and the like are used. For this reason, the application treatment can be performed while maintaining the designs and the like of the sublimation dye stuck to the label cloth successfully when the label cloth is applied to, for example, a uniform cloth by using a heating and pressing machine or the like after the designs and the like are formed using the sublimation dye.

(Label Cloth)

As the label cloth constituting the cloth material for marking, any material may be used without any particular limitation insofar as it is a cloth having, at least, heat resistance which can stand to the transfer condition of the sublimation dye, and conventional clothes made of fibers usually used for the production of marks may be used. At this time, the clothes are preferably those using textile fabrics, knitted fabrics and non-woven fabrics made of fibers composed of components having affinity for the sublimation dye. Typical examples of the fibers composed of components having affinity for the sublimation dye include clothes formed using a polyester fiber, a nylon fiber, a polyurethane fiber and a mixed fiber thereof. Further, clothes formed using cotton or blended fabric thereof may be available. Among these clothes, clothes formed using polyester fibers are preferable in consideration of adhesion to the resin forming the intermediate layer which will be described later. When, using transfer paper using a sublimation dye, colors, patterns and designs are transferred to the cloth by the sublimation of the sublimation dye, a cloth made of polyester fibers is superior to a cloth made of a nylon-based synthetic resin in firm bonding of the sublimation dye and therefore, the transfer of colors, patterns and designs formed by the dyes sublimated from the transfer paper is clearly made. Furthermore, no particular limitation is imposed on the color of the cloth constituting the label cloth, and may be appropriately selected corresponding to an object. It is preferable to use a white cloth taking the color developing ability and general-purpose of the mark use into account.

(Intermediate Layer)

The intermediate layer is disposed on the rear surface (the side opposite to the surface on which designs and the like are formed) of the label cloth which is the aforementioned cloth. The above intermediate layer has a structure including a resin having a softening temperature of 180° C. or higher. The term "softening point" of the resin in this application means a Vicat softening temperature prescribed in JIS K-7206 (1999). The description of JIS K-7206 (1999) is incorporated by reference herein. The intermediate layer is preferably one which is neither deformed nor melted by heat and pressure when colors, patterns and designs are transferred. If the softening point of the resin constituting the intermediate layer is less than 180° C., the resin constituting the intermediate layer is also softened together with the thermoplastic resin constituting the adhesive transfer layer when a sublimation dye is used to carry out sublimation transfer in the condition: for example, temperature: 180° C., pressure: 1 g/cm$^2$, time: 45 sec., and therefore, the thermoplastic resin cannot be prevented from seeping and soaking into the surface of the label cloth. The softening point of the resin constituting the intermediate layer may be properly determine in consideration of the sublimation temperature of the sublimation dye which is to be used and the transfer conditions. The lower limit of the softening point thereof is preferably 185° C. or higher, more preferably 195° C. or higher and particularly preferably 210° C. or higher. Further, the softening point of the resin constituting the intermediate layer is preferably 185 to 250° C., more preferably 195 to 245° C. and even more preferably about 210 to 240° C. in consideration of, for example, the sublimation transfer conditions of the sublimation dye and handling characteristics when the layer is formed.

As the resin used to form the intermediate layer, an appropriate one may be selected from known synthetic resins corresponding to an intended purpose insofar as it has the aforementioned softening point. As the above resin, a thermoplastic resin is preferable from the viewpoint of handling characteristics and the like though any of thermoplastic resins and thermosetting resins may be used. With regard to examples of the above resin, a proper one is preferably selected also in consideration of the material constituting the label cloth and adhesion to the thermoplastic resin to be used in the adhesive transfer layer though a commercially available resin having high heat resistance (high softening point) may be optionally used. Examples of such a resin include urethane based resins and, for example, a mixture of aliphatic polyester based polyurethane and polyether based polyurethane (hereinafter simply recite as aliphatic polyester-polyether based polyurethane) may be used. An example thereof includes Polymack DL-470E (trade name: manufactured by Nihon Polymac Inc., softening point: 220 to 230° C.).

The intermediate layer may be formed by applying a film made of the above resin to the rear surface of the label cloth by the laminating method or coating method. The film thickness of the intermediate layer is preferably 10 μm to 130 μm and more preferably 50 μm to 100 μm from the viewpoint of durability in washing and abrasion resistance but it may be properly selected according to an intended purpose without any particular limitation.

(Transfer Adhesive Layer)

In the present invention, the transfer adhesive layer is formed such that the intermediate layer is intermediated between the label cloth and the transfer adhesive layer. The transfer adhesive layer is a so-called hot-melt layer used to bond a cloth such as a uniform to a label cloth. In the present invention, the transfer adhesive layer contains a thermoplastic resin having a softening point of 170° C. or lower and a melt flow rate of 100 g/10 min or lower.

Here, the term "softening point" means a Vicat softening temperature prescribed in JIS K-7206 (1999) similarly to the softening point of the resin constituting the above intermediate layer. The conditions under which a usual processor applies the cloth material for marking to clothes such as uniforms and shirts are as follows: temperature: 130 to 170° C., pressure: 100 to 1,000 g/cm$^2$, time: 20 to 60 sec. When the softening point of the transfer adhesive layer exceeds 170° C., it is necessary to heat at a temperature higher than the above conditions, bringing about increase in cost and there is a fear as to deterioration in the quality of the subject to which the cloth material is applied such as uniforms. The softening point of the above thermoplastic resin may be properly selected in consideration of bonding conditions of the object to be bonded. The upper limit of the softening point of the thermoplastic resin is preferably 160° C. or lower, more preferably 150° C. or lower. Further, the softening point of the thermoplastic resin is preferably 70 to 170° C. and more preferably 80 to 150° C. from the viewpoint of the preserving property of the cloth material for marking before the cloth material is applied and durability in washing and abrasion resistance after the cloth material is applied and in consideration of the application conditions of usual marks.

Further, the difference between the softening point of the resin constituting the intermediate layer and the softening point of the thermoplastic resin constituting the transfer adhesive layer is preferably 10° C. or more, more preferably 20° C. or more, even more preferably 30° C. or more, from the viewpoint that the intermediate layer is not affected by the heating temperature at the time of bonding the label cloth to a object to be bonded.

In this application, the term "melt flow rate" has the same meanings as the melt index (MI) and means a value measured at a temperature of 190° C. under a load of 8.76 kg according to JIS-K7210 B (1999). The description of JIS K-7210 B (1999) is incorporated by reference herein. When the melt flow rate of the thermoplastic resin constituting the transfer adhesive layer exceeds 100 g/min, a molten thermoplastic resin penetrates into pinholes and fine cracks in the intermediate layer and reaches the label cloth with the result that it seeps and soaks into the surface of the label cloth in the case of carrying out sublimation transfer by using a sublimation dye in the, for example, following condition: temperature: 180° C., pressure: 1 g/cm$^2$, time: 45 sec. The melt flow rate of the thermoplastic resin is preferably 60 to 100 g/min, more preferably 65 to 95 g/min and even more preferably 70 to 90 g/min in consideration of the formation efficiency such as the coatability and moldability of the transfer adhesive layer. The above melt flow rate may be determined by measuring a subject thermoplastic resin several times according to JIS-K7210 B (1999) to calculate an average of these measured values. Though no particular limitation is imposed on a method of adjusting the melt flow rate, the thermoplastic resin can be thickened (melt flow rate is decreased), for example, by increasing the molecular weight of the polymer.

As the thermoplastic resin forming the transfer adhesive layer, any commercially available resin may be properly used insofar as it satisfies the requirements for the softening point and melt flow rate. It is however preferable to use a hot-melt thermoplastic synthetic resin having affinity for the resin forming the intermediate layer. Examples of the thermoplastic resin include thermoplastic polyurethanes of which the softening point and viscosity are adjusted to meet the above requirements. The polyurethane has high adhesiveness, particularly, to the intermediate layer when the aforementioned mixture of aliphatic polyester-polyether based polyurethane is used for the intermediate layer. As the thermoplastic polyurethane, for example, commercially available products (trade name: "SHM103-PUB", manufactured by Sheedom Co., Ltd., softening point: 90° C., melt flow rate (condition: 190° C., 8.76 kg): 78.71 g/10 min in average) may be used.

Furthermore, the transfer adhesive layer may be formed by applying a film made of the thermoplastic resin to the rear surface (the side opposite to the surface on which the label cloth is disposed) of the intermediate layer according to the laminating method or coating method. Although there is no particular limitation to the film thickness of the transfer adhesive layer and an appropriate thickness may be selected according to an intended purpose, the film thickness is preferably 10 μm to 150 μm and more preferably 50 μm to 100 μm from the viewpoint of applicability to an object material, durability in washing and abrasion resistance.

(Release Sheet)

The release sheet is a sheet-like material (with which the transfer adhesive layer is lined) applied to the rear surface (the side opposite to the surface on which the intermediate layer of the transfer adhesive layer is formed) and is releasable from the thermoplastic resin constituting the transfer adhesive layer. Due to the constitution in which the cloth material for marking according to the present invention is provided with the release sheet, this prevents the occurrence of such a phenomenon that the thermoplastic resin melted by heat and pressure when the sublimation dye is transferred to the cloth material for marking before the cloth material is applied is adhered to others. As the release sheet, an appropriate one may be selected from commercially available release sheets, such as, release paper and resin films, which have been subjected to release treatment, and for example, mounts coated with polyethylene or silicon may be used according to the type of the thermoplastic resin material used for the transfer adhesive layer.

—Method for Forming Mark—

In the present invention, the method of forming a mark is a method in which a pattern formed on a transfer sheet by using a sublimation dye is transferred onto the cloth material for marking to form a mark, the method including a pattern forming step of sublimation-transferring a pattern formed on a transfer sheet with the sublimation dye onto the surface of the label cloth of the cloth material for marking, the cloth material for marking including, in this order, at least a label cloth formed from a fiber, an intermediate layer containing a resin having a softening point higher than the sublimation temperature of the sublimation dye, a transfer adhesive layer containing a thermoplastic resin having a softening point lower than the sublimation temperature of the sublimation dye and a melt flow rate of 100 g/10 min or lower, and a release sheet. The method of forming a mark according to the present invention may involve a cutting step of cutting the cloth material for marking into a desired form as needed.

(Pattern Forming Step)

The method of forming a mark according to the present invention involves a step of sublimation-transferring the pattern formed on a transfer sheet with a sublimation dye onto the surface of the label cloth of the cloth material for marking. The sublimation dye is a dye having the characteristics that it forms a molecular bond with a polymer to dye the cloth by applying heat. Generally, the sublimation dye is used after additives such as a dispersion stabilizer are blended. Though there is no particular restriction to the sublimation dye used in the present invention and a commercially available sublimation dye may be properly selected, it is preferable to use a sublimation dye having a softening temperature of 220° C. or lower in consideration of, for example, production cost and the softening point of polyester which is preferably used as a label cloth.

In the method of forming a mark according to the present invention, the formation of a pattern is carried out by transferring the sublimation dye onto the surface of the label cloth. As the transfer sheet to be used for the sublimation transfer, an appropriate one may be selected from known sublimation transfer sheets prepared using a sublimation dye to form patterns such as designs by printing on transfer paper.

(Cloth Material for Marking)

The cloth material for marking used in the method of forming a mark according to the present invention contains, in this order, at least a label cloth formed from a fiber, an intermediate layer containing a resin having a softening point higher than the sublimation temperature of the sublimation dye, a transfer adhesive layer containing a thermoplastic resin having a softening point lower than the sublimation temperature of the sublimation dye and a melt flow rate of 100 g/10 min or lower, and a release sheet. The cloth material for marking which is used in the method of forming a mark according to the present invention has the same layer structure as the aforementioned cloth material for marking according to the present invention. Here, the label cloth and the release sheet are the same as those mentioned above, and explanations of these materials are omitted.

The intermediate layer in the cloth material for marking which is used in the method of forming a mark according to the present invention contains a resin having a softening point higher than the sublimation temperature of the sublimation dye. As the resin forming the intermediate layer, an appropriate one may be selected from known synthetic resins corresponding to an intended purpose as long as it has a softening point higher than the sublimation temperature of the sublimation dye. As the resin, a thermoplastic resin is preferable from the viewpoint of, for example, handling characteristics though either a thermoplastic resin or thermosetting resin may be used. As the resin, it is preferable to select an appropriate one in consideration of the material constituting the label cloth and adhesion to the thermoplastic resin used for the adhesive transfer layer, though a commercially available resin having high heat resistance (high softening point) may be optionally used. When the sublimation temperature of the sublimation dye is 180 to 210° C., it is preferable that the cloth material used in this method be provided with the same intermediate layer using the same kind of resin as the resin used for the intermediate resin in the aforementioned cloth material for marking according to the present invention. Further, the softening point of the resin constituting the intermediate layer is preferably higher than the heating temperature in the pattern forming step in which sublimation dye is sublimation transferred.

The transfer adhesive layer used in the cloth material for marking which is used in the method of forming a mark according to the present invention contains a thermoplastic resin having a softening point lower than the sublimation temperature of the sublimation dye and a melt flow rate of 100 g/10 min or lower. As the thermoplastic resin forming the transfer adhesive layer, an appropriate one may be selected from known thermoplastic resins corresponding to an intended purpose as long as it has a softening temperature lower than the sublimation point of the sublimation dye and a melt flow rate of 100 g/10 min or lower. Examples of the thermoplastic resin include thermoplastic polyurethanes of which the softening point and viscosity are regulated to meet the above requirements. The polyurethane has high adhesiveness, particularly, to the intermediate layer when the aforementioned mixture of aliphatic polyester-polyether based polyurethane is used for the intermediate layer. When the sublimation temperature of the sublimation dye is 180 to 210° C., it is preferable that the cloth material used in this method be provided with the same kind of transfer adhesive layer using the same kind of thermoplastic resin as the resin used for the transfer adhesive layer in the aforementioned cloth material for marking according to the present invention.

Further, the difference between the softening point of the resin constituting the intermediate layer and the softening point of the thermoplastic resin constituting the transfer adhesive layer is preferably 10° C. or more, more preferably 20° C. or more, even more preferably 30° C. or more, from the viewpoint that the intermediate layer is not affected by the heating temperature at the time of bonding the label cloth to a object to be bonded.

The transfer of a pattern onto the surface of the label cloth of the cloth material for marking can be accomplished by overlaying the transfer sheet with a pattern formed using a sublimation dye on the cloth material for marking such that the pattern formed using the sublimation dye is brought into contact with the surface of the label cloth, followed by heating and pressing using a heating/pressing machine or the like. The sublimation condition at this time is preferably as follows: temperature: 180 to 210° C., pressure: 1 to 300 g/cm$^2$, time: about 45 to 60 sec, in the case of using a sublimation dye having a sublimation temperature of about 180 to 210° C., though no particular limitation is imposed on this condition. A pattern using a sublimation dye can be formed on the surface of the cloth material for marking by carrying out such sublimation transfer treatment.

Hereinafter, a cloth material for marking of the present invention will be explained in more detail with reference to figures. A cloth material for marking 20 of the present invention has a structure as shown in FIG. 1. In FIG. 1, a cloth material for marking 20 is composed of a label cloth 21, a heat-resistant intermediate layer 22, a transfer adhesive layer 23 and a sheet of release sheet 24. A cloth that forms a label cloth 21 constituting the cloth material for marking 20 of the present invention is made of fibers including a component having affinity for a sublimation dye. Typical examples of the cloth used here include a white cloth such as textile white fabrics, knitted white fabrics, non-woven white fabrics, etc. like polyester fibers.

Further, the label cloth 21 is preferably made of a fabric comprising a component capable of enduring the sublimation temperature of the sublimation dye mentioned above, since the label cloth 21 is transfer-printed by using the transfer paper in a manner such that the sublimation dye having been printed on the transfer paper is subjected to heating and pressing processes to sublimate so that the colors, patterns, designs and/or the like of the transfer paper are transferred to the cloth.

A heat-resistant intermediate layer 22, which is made of a thermoplastic synthetic resin having affinity with the label cloth 21, is formed on a rear surface of the label cloth 21. As the thermoplastic resin, a mixture of aliphatic polyester-polyether based polyurethane having a softening point of 180° C. or more, and the like, may be used.

This heat-resistant intermediate layer 22 may be formed by coating the thermoplastic resin with a solvent, or laminating a film made of the thermoplastic resin, on a rear surface of the label cloth 21, so that the intermediate layer 22 has a thickness of approximately within a range of 20 μm to 70 μm.

The intermediate layer 22 is preferably made of material which does not be deformed or melted during the heating and pressing processes in which colors, patterns, designs and/or the like are transferred from a transfer paper to the label cloth 21. In other words, the intermediate layer 22 and the label cloth 21 are preferably made of materials having heat resistant temperatures comparable with each other.

Formed in a rear surface of the intermediate layer 22 is a transfer adhesive layer 23 made of a hot-melt type thermoplastic synthetic resin, which has affinity for the thermoplastic resin of the intermediate layer 22. That transfer adhesive layer 23 may be formed by coating the thermoplastic synthetic resin with a solvent, or laminating a film of the thermoplastic synthetic resin, on the rear surface of the intermediate layer 22.

As the thermoplastic resin constituting the transfer adhesive layer 23, a thermoplastic resin having a softening point of 170° C. or lower and a melt flow rate of 100 g/10 min or lower is used. As the thermoplastic resin like this, a thermoplastic polyurethane or the like regulated to have a softening point and viscosity meeting the above requirements may be used.

Further, a release sheet 24 may be applied to the rear surface of the transfer adhesive layer 23 according to a usual method.

In order to prepare the cloth material for marking 20 provided with the label cloth 21 bearing the desired colors, patterns and/or designs, the white cloth of the label cloth 21 of the cloth material for marking 20 is overlaid with a printed surface of a transfer paper, wherein the transfer paper has been printed with the sublimation dye to bear the desired colors, patterns and/or designs on its printed surface and subjected to heating and pressing processes in which the transfer paper and the white cloth overlaid therewith are heated for a time period of about 60 seconds at a temperature of approximately 200° C. under about 300 g/cm$^2$ of pressure.

Through this operation, the sublimation dye used in printing to express the desired colors, patterns, and/or designs is transferred from the transfer paper to the white label cloth 21, so that the desired colors, patterns, and/or designs are formed with the sublimation dye on a surface of the white label cloth.

During this operation, the transfer adhesive layer 23 made of the thermoplastic synthetic resin having a softening point of 170° C. or lower and a melt flow rate of 100 g/10 min or lower, is melted between the intermediate layer 22 and the release sheet 24 by the heating and pressing operation. Because of the intermediate layer 22 disposed on the white label cloth 21 as a component of the cloth material for marking 20 of the present invention, there is no concern that the synthetic resin which has been melted and forms a component of the transfer adhesive layer 23 seeps or soaks into the label cloth 21. Further, there is neither a concern that such molten resin seeps or soaks through the release sheet.

Consequently, in contrast with the conventional process, in the present invention defective products would not be produced.

In other words, if only a label maker, who produces a label or mark in the art obtained the cloth material for marking 20, the label maker would be able to produce a label cloth for marking of the present invention, where the label cloth has been transfer-printed using a conventional type of heating and pressing machine and the transfer paper having been printed with the sublimation dye to bear the desired colors, patterns, and/or designs.

Figure 2:
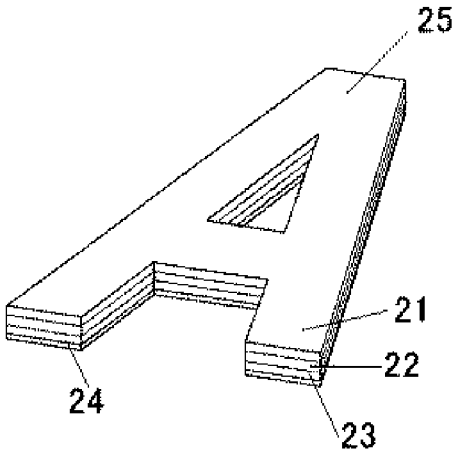
FIG. 2 is a perspective view of a label produced with a cloth material for marking according to the present invention.
Figure 3:
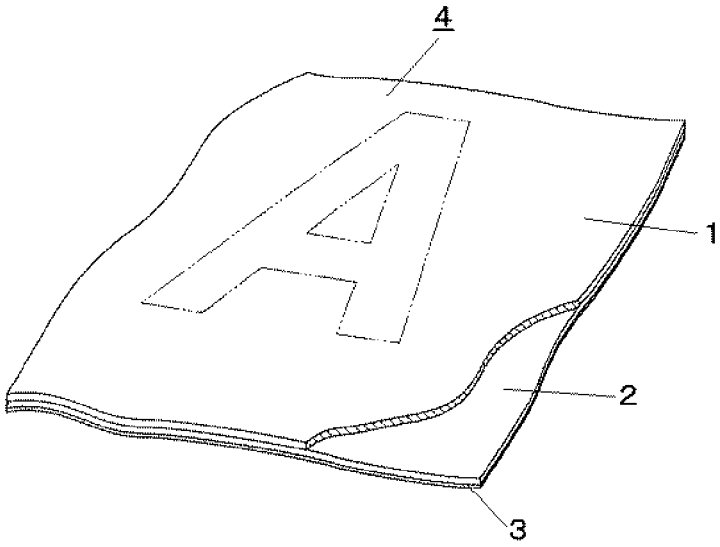
FIG. 3 is a partially broken perspective view of a conventional cloth material for marking.
Figure 4:
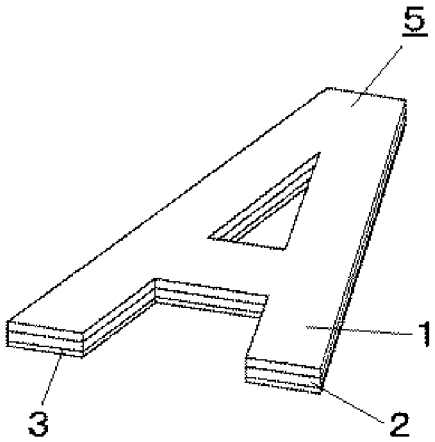
FIG. 4 is a perspective view of a label produced with a conventional cloth material for marking.
Figure 5:
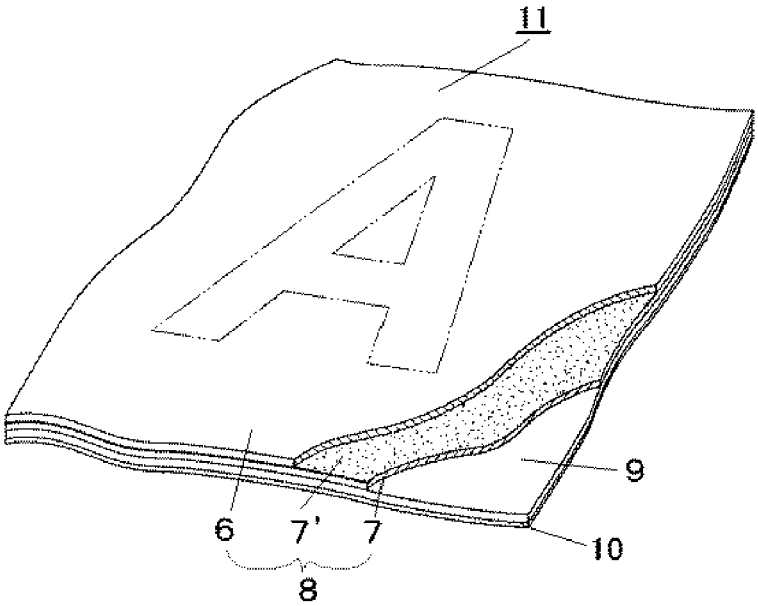
FIG. 5 is a partially broken perspective view of a conventional cloth material for marking produced with a composite cloth.
Figure 6:
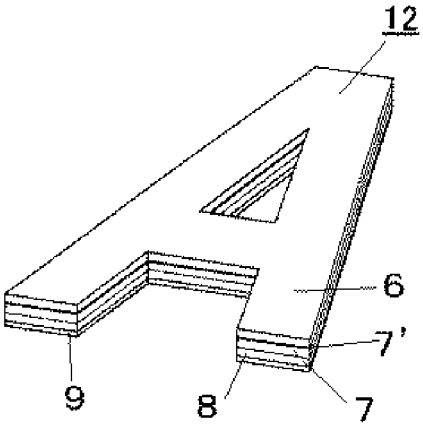
FIG. 6 is a perspective view of a label produced with a conventional cloth material for marking

In processes for obtaining a label or mark from the cloth material for marking of the present invention, it is natural that the label maker uses a conventional method to cut the cloth material into a desired shape so as to obtain label 25 shown in FIG. 2.

Further, it is also natural to apply the label 23 to a uniform or like items according to the conventional method in the art.

Exemplary embodiments according to the present invention will be listed below.

<1> A cloth material for marking comprising, in this order: a label cloth formed from a fiber; an intermediate layer comprising a resin having a softening point of 180° C. or higher; a transfer adhesive layer comprising a thermoplastic resin having a softening point of 170° C. or lower and having a melt flow rate of 100 g/10 min or lower; and a release sheet.

<2> The cloth material for marking according to <1>, wherein the resin having a softening point of 180° C. or higher comprises a first urethan resin.

<3> The cloth material for marking according to <2>, wherein the first urethan resin comprises a first mixture of aliphatic polyester-polyether polyurethane.

<4> The cloth material for marking according to any one of <1> to <3>, wherein the thermoplastic resin comprises a second urethan resin.

<5> The cloth material for marking according to <4>, wherein the second urethan resin comprises a second mixture of aliphatic polyester-polyether polyurethane.

<6> A method of forming a mark, the method comprising: providing a cloth material for marking; and sublimation transferring a pattern formed on a transfer sheet with a sublimation dye onto a surface of the cloth material, wherein the cloth material comprises, in this order, at least a label cloth formed from a fiber, an intermediate layer comprising a resin having a softening point higher than a sublimation temperature of the sublimation dye, a transfer adhesive layer comprising a thermoplastic resin having a softening point lower than the sublimation temperature of the sublimation dye and having a melt flow rate of 100 g/10 min or lower, and a release sheet.

<7> The method of forming a mark according to <6>, wherein the resin included in the intermediate layer comprises a first urethan resin.

<8> The method of forming a mark according to <7>, wherein the first urethan resin comprises a first mixture of aliphatic polyester-polyether polyurethane.

<9> The method of forming a mark according to any one of <6> to <8>, wherein the thermoplastic resin comprises a second urethan resin.

<10> The method of forming a mark according to <9>, wherein the second urethan resin comprises a second mixture of aliphatic polyester-polyether polyurethane.

EXAMPLES

The present invention will be explained in detail by way of examples.

Example 1

A cloth material for marking which had a structure as shown in the following Table 1 and a size of 10 cm×10 cm was manufactured. First, an intermediate layer was applied to the rear surface of the label cloth and then, dried to form an intermediate layer. The surface of the intermediate layer was observed by a microscope to confirm that pinholes were generated. An average of 10 pinholes (per 1 $cm^2$), each having a diameter of about 10 to 200 μm was confirmed in the intermediate layer. Then, a transfer adhesive layer was formed on the intermediate layer by coating and further, release sheet was laminated on the transfer adhesive layer to produce a cloth material for marking <Evaluation of Seeping and Soaking>

The obtained cloth material for marking was subjected to a heating/pressing machine to carry out sublimation transfer treatment using a sublimation transfer sheet constituted of release sheet on which a pattern was formed using a sublimation dye. At this time, the sublimation transfer treatment was carried out in the following condition: temperature: 210° C., pressure: 1 g/$cm^2$, time: 45 sec. After the sublimation transfer treatment, the release sheet of the sublimation transfer sheet was peeled from the cloth material for marking, and as a result, the label cloth and release sheet were not bonded with each other and could be peeled smoothly from each other. Furthermore, when the surface of the label cloth on which a pattern was formed was observed visually, no seeping and soaking of the resin was confirmed. In this case, in the sublimation transfer sheet, four colors (black, magenta, yellow and cyan) of sublimation dye (trade name: DIGISTAR DES ELITE, manufactured by KIIAN S. P. A) were used. The sublimation temperature of the sublimation dye used is within the range of from 180 to 210° C., though it differs depending on the colors.

<Peeling Resistance>

Using a cloth material for marking on which a pattern was formed, a 180° peeling test was made according to ASTM D903. The description of ASTM D903 is incorporated by reference herein. The bonding condition was as follows: temperature: 150° C., pressure: 200 g/$cm^2$, time: 30 sec. This test was made three times and an average of these tests was calculated. The results are shown in Table 1.

<Washing Fastness>

The release sheet was peeled from the cloth material for marking on which a pattern was formed to apply a mark to a commercially available polyester uniform under the following bonding condition: temperature: 150° C., pressure: 200 g/$cm^2$, time: 30 sec. Then, using a household washing machine, a process cycle: washing-rinsing-dewatering for 45 min/cycle, was repeated 50 times to observe discoloration of a mark and peeling condition, to thereby evaluate these results according to the following criteria. The results are shown in Table 1.

A: Discoloration of a mark and peeling were not observed.

B: Discoloration of a mark and peeling were slightly observed.

C: Discoloration of a mark and peeling were much observed.

[Comparative Example 1]

In Comparative Example 1, a cloth material for marking was produced in the same manner as in Example 1 except that the thermoplastic resin (SHM-103-PUB) used for the adhesive transfer layer was altered to a thermoplastic resin (trade name: SHM107-PUR, manufactured by Sheedom Co., Ltd.) and evaluated in the same manner as in Example 1. In this case, the release sheet of the sublimation transfer sheet was peeled from the cloth material for marking after the sublimation transfer, and as a result, that the label cloth was bonded with part of the release sheet, giving rise to paper breakage. Furthermore, the surface of the label cloth on which a pattern was formed was visually observed to confirm seeping and soaking of a resin.

TABLE 1

| | | Example 1 | Comparative Example 1 |
|---|---|---|---|
| Layer structure | Label cloth | Polyester based fabric | Polyester based fabric |
| | Intermediate layer | Aliphatic polyester-polyether based polyurethane-water dispersion solution<br>Polymac DL-470E<br>Film thickness: 70 μm<br>Softening point: 220 to 230° C. | Aliphatic polyester-polyether based polyurethane-water dispersion solution<br>Polymac DL-470E<br>Film thickness: 70 μm<br>Softening point: 220 to 230° C. |
| | Transfer adhesive layer | Thermoplastic polyurethane<br>SHM103-PUB<br>Film thickness: 90 μm<br>MI value: 78.71 g/10 min (190° C., 8.76 kg)<br>Softening point: 90° C. | Thermoplastic polyurethane<br>SHM107-PUR<br>Film thickness: 90 μm<br>MI value: 106.39 g/10 min (190° C., 8.76 kg)<br>Softening point: 80° C. |
| | Release sheet | Glassine paper | Glassine paper |

TABLE 1-continued

| | | Example 1 | Comparative Example 1 |
|---|---|---|---|
| Evaluation | Seeping and soaking | None | Observed |
| | Peeling resistance | 11.60 Kgf | 11.10 Kgf |
| | Durability in washing | A | A |

Label cloth

Polyester fiber (100% of polyester), sateen weave satin which is white in color manufactured by HOULAISHA CO., LTD.

Intermediate layer

Trade name: Polymac DL-470E, manufactured by Nihon Polymac Inc.

Transfer adhesive layer

Trade name: SHM103-PUB, manufactured by Sheedom Co., Ltd.

*Melt flow rate (load: 8760 g): 0.7 (120° C.), 18.89 (160° C.), 78.71 (190° C.) (unit: g/10 min) Trade name: SHM107-PUR, manufactured by Sheedom Co., Ltd.

*Melt flow rate (load: 8760 g): 5.3 (125° C.), 22.68 (160° C.), 106.39 (190° C.) (unit: g/10 min) Release sheet Glassine paper, trade name: WG, manufactured by Lintec Corporation.

As is clear from Table 1, the cloth material for marking in Example 1 using a thermoplastic polyurethane having a MI value (has the same meaning as Melt flow rate) of 100 g/10 min or lower enabled the formation of a good pattern without any seeping and soaking of a resin constituting the transfer adhesive layer after the sublimation transfer. Furthermore, with regard to the peeling resistance and durability in washing, good results were obtained. In the case of the cloth material for marking in Comparative Example 1 using a thermoplastic polyurethane having a MI value exceeding 100 g/10 min, though good peeling resistance and durability in washing were obtained, seeping and soaking arose on the surface of the label cloth, resulting in paper breakage of the transfer paper in the sublimation transfer process.

<Wear Comfortability>

By using each of the cloth materials for marking obtained in Example 1 and Comparative Example 1, a mark and a uniform number were formed on chest position and back position on T-shirt made of 100% polyester. The T-shirt formed the mark and the uniform number using the cloth material for marking obtained in Example 1 was soft and comfortable to wear. On the other hand, the T-shirt formed the mark and the uniform number using the cloth material for marking obtained in Comparative Example 1 was uncomfortable to wear since the surface thereof was harsh and hard. The cause may be that the transfer adhesive layer seeped and soaked on the surface of the label cloth at the time of sublimation transfer.

The invention claimed is:

1. A cloth material for marking comprising, in this order:

a label cloth formed from a fiber;

an intermediate layer comprising a resin having a softening point of 180° C. or higher;

a transfer adhesive layer comprising a thermoplastic resin having a softening point of 170° C. or lower and having a melt flow rate of 100 g/10 min or lower; and a release sheet.

2. The cloth material for marking according to claim 1, wherein the resin having a softening point of 180° C. or higher comprises a urethane resin.

3. The cloth material for marking according to claim 2, wherein the urethane resin comprises a mixture of aliphatic polyester-polyether polyurethane.

4. The cloth material for marking according to claim 2, wherein the thermoplastic resin comprises a thermoplastic polyurethane.

5. The cloth material for marking according to claim 3, wherein the thermoplastic resin comprises a thermoplastic polyurethane.

6. The cloth material for marking according to claim 1, wherein the thermoplastic resin comprises a thermoplastic polyurethane.

7. A method of forming a mark, the method comprising:

providing a cloth material for marking; and sublimation transferring a pattern formed on a transfer sheet with a sublimation dye onto a surface of the cloth material, wherein the cloth material comprises, in this order, at least a label cloth formed from a fiber, an intermediate layer comprising a resin having a softening point higher than a sublimation temperature of the sublimation dye, a transfer adhesive layer comprising a thermoplastic resin having a softening point lower than the sublimation temperature of the sublimation dye and having a melt flow rate of 100 g/10 min or lower, and a release sheet.

8. The method of forming a mark according to claim 7, wherein the resin included in the intermediate layer comprises a urethane resin.

9. The method of forming a mark according to claim 8, wherein the urethane resin comprises a mixture of aliphatic polyester-polyether polyurethane.

10. The method of forming a mark according to claim 9, wherein the thermoplastic resin comprises a thermoplastic polyurethane.

11. The method of forming a mark according to claim 8, wherein the thermoplastic resin comprises a thermoplastic polyurethane.

12. The method of forming a mark according to claim 7, wherein the thermoplastic resin comprises a thermoplastic polyurethane.

* * * * *